US011435090B2

(12) United States Patent
Rehage et al.

(10) Patent No.: US 11,435,090 B2
(45) Date of Patent: Sep. 6, 2022

(54) FASTENING SYSTEM AND METHOD FOR INSTALLING A FASTENING SYSTEM HAVING A PULLOUT GUIDE AND A SIDE GRID

(71) Applicant: PAUL HETTICH GMBH & CO. KG, Kirchlengern (DE)

(72) Inventors: Daniel Rehage, Chemnitz (DE); Kathrin Homburg, Bünde (DE); Johann-Sebastian Leßmann, Paderborn (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 1126 days.

(21) Appl. No.: 16/003,407

(22) Filed: Jun. 8, 2018

(65) Prior Publication Data

US 2019/0056117 A1 Feb. 21, 2019

Related U.S. Application Data

(60) Provisional application No. 62/545,699, filed on Aug. 15, 2017.

(51) Int. Cl.
*F24C 15/16* (2006.01)

(52) U.S. Cl.
CPC ..... *F24C 15/16* (2013.01); *F24C 15/168* (2013.01)

(58) Field of Classification Search
None
See application file for complete search history.

(56) References Cited

U.S. PATENT DOCUMENTS

2009/0016812 A1* 1/2009 Wittgrebe ..... A47B 88/43 403/189
2017/0303685 A1* 10/2017 Rehage ..... A47B 88/57
2018/0084910 A1 3/2018 Homburg et al.

FOREIGN PATENT DOCUMENTS

DE 20010037 U1 * 8/2000 ..... A47B 55/02
DE 202004005475 U1 * 8/2004 ..... F24C 15/16
DE 202005020458 U1 * 6/2007 ..... A47B 88/43
DE 202006002251 U1 * 7/2007 ..... A47L 15/504
DE 202008010187 U1 * 1/2010 ..... F24C 15/168
DE 202008010188 U1 * 1/2010 ..... F24C 15/168
DE 202009003045 U1 * 8/2010 ..... A47B 88/044
DE 202009005177 U1 * 3/2011 ..... A47B 88/43
DE 102010021283 A1 * 11/2011 ..... F16B 1/02

(Continued)

*Primary Examiner* — Jorge A Pereiro
(74) *Attorney, Agent, or Firm* — Barnes & Thornburg LLP

(57) ABSTRACT

A fastening system comprises a side grid, a pullout guide, and multiple fastening elements fixed on the pullout guide, by means of which the pullout guide is fixed in a formfitting manner on a horizontal rod of the side grid, wherein the horizontal rod has a middle section extending in a longitudinal direction and two angled end sections, which are each fixed on an upright of the side grid, wherein at least a front fastening element has at least one contact surface inclined in relation to the vertical for contact on the middle section of the rod, and at least one rear fastening element has a contact surface inclined in relation to the vertical on the middle section of the rod, wherein an essentially V-shaped receptacle is formed on the front fastening element, which encloses the front angled end section of the rod from above. Furthermore, the invention relates to a method for installing a fastening system.

22 Claims, 17 Drawing Sheets

(56) References Cited

FOREIGN PATENT DOCUMENTS

| | | | | | |
|---|---|---|---|---|---|
| DE | 102011056303 | A1 * | 6/2013 | ..... | A47B 88/43 |
| DE | 102011056304 | A1 * | 6/2013 | ..... | A47B 88/43 |
| DE | 202013102739 | U1 * | 9/2013 | ..... | A47B 88/04 |
| DE | 202014100932 | U1 * | 5/2014 | ..... | A47B 88/43 |
| DE | 10-2015-110754 | | 3/2016 | | |
| DE | 10-2016-118267 | | 3/2018 | | |
| EP | 1158185 | A2 * | 11/2001 | ..... | A47B 55/02 |
| EP | 2487422 | A1 * | 8/2012 | ..... | F24C 15/168 |
| EP | 3225919 | A1 * | 10/2017 | ..... | F24C 15/16 |
| WO | WO-2007090738 | A1 * | 8/2007 | ..... | A47L 15/504 |
| WO | WO-2011023561 | A1 * | 3/2011 | ..... | A47B 88/43 |

* cited by examiner

FASTENING SYSTEM AND METHOD FOR INSTALLING A FASTENING SYSTEM HAVING A PULLOUT GUIDE AND A SIDE GRID

CROSS-REFERENCE TO RELATED APPLICATION

This application claims benefit under 35 U.S.C. § 119 of U.S. Provisional Patent Application No. 62/545,699, filed on Aug. 15, 2017, and incorporates by reference the disclosure thereof in its entirety.

BACKGROUND AND SUMMARY OF THE DISCLOSURE

The present disclosure relates to a fastening system having a side grid, a pullout guide, and multiple fastening elements fixed on the pullout guide, by means of which the pullout guide is fixed in a formfitting manner on a horizontal rod of the side grid, wherein the horizontal rod has a middle section extending in a longitudinal direction and two angled end sections, which are each fixed on an upright of the side grid, wherein at least one front fastening element has at least one contact surface inclined in relation to the vertical for contact on the middle section of the rod, and at least one rear fastening element has at least one contact surface inclined in relation to the vertical on the middle section of the rod. Furthermore, the present disclosure relates to a method for installing a fastening system having a pullout guide and a side grid.

DE 10 2015 110 754 A1 discloses a fastening system for fixing a pullout guide on a side grid, wherein a quick fastening element is plastically deformed on a pullout guide to fix it on a horizontal rod of the side grid without play. Due to such a plastic deformation, the quick fastening elements can be used for side grids having rods having different diameters. However, the subsequent deformation of the quick fastening elements results in a certain installation effort.

Subsequently published DE 10 2016 118 267 discloses a mounting bracket for fixing a pullout guide on a side grid, in which a clamping section, which has wall sections widening at an acute angle, is formed on three side walls bent in a U shape in relation to one another. This enables the fixing of the mounting bracket even manually, wherein rods having different diameters can be fixed by the clamping section.

The present disclosure is directed to a fastening system having a side grid, a pullout guide, and multiple fastening elements fixed on the pullout guide, and also a method for installing such a fastening system which ensures substantially play-free fixing of the pullout guide on a side grid and is easy to install.

In the fastening system according to the disclosure, a substantially V-shaped receptacle is formed on the front fastening element, which encloses the front angled end section of the rod from above. For fixing the pullout guide, furthermore at least one rear fastening element is provided, which has a contact surface inclined in relation to the vertical for contact on the middle section of the rod, so that a play-free arrangement of the pullout guide is possible for use even if the diameters of the rod vary in certain ranges. Fastening of the fastening system on rods having different diameters is also thus possible. A diameter change in the rod may be compensated for by the inclined contact surface, without play occurring between one of the fastening elements and the rod. The play relates in this case not to a movement upward opposite to the direction of gravity, but rather to the loads occurring during use of the pullout guide in the pullout direction, in the horizontal direction perpendicular thereto, and a tilt load for the extended position of the pullout guide. Therefore, lifting of the pullout guide at the front fastening element can be permitted, since this is obviously not a usage load.

All contact surfaces of the fastening elements which can be applied to the horizontal rod are preferably formed inclined in relation to the horizontal and vertical. Better play-free clamping fastenings may thus be implemented between the fastening elements and the horizontal rod. The contact surfaces can be inclined in this case at least 10° in relation to the vertical, for example, between 20° and 40°, wherein a contact surface on the rearmost fastening element, which engages below the horizontal rod, is inclined in relation to the horizontal by at least 10°, for example, between 20° and 40°.

In a further embodiment, at least three fastening elements, in particular precisely three fastening elements are fixed on the pullout guide. In this case, a single fastening element is preferably arranged on the end section of the horizontal rod located in front in the pullout direction, while two rear fastening elements spaced apart from one another are provided in the rear region viewed in the pullout direction, between which a gap is formed for threading in the front end section of the rod. Due to the gap, the fastening element can be used with rods having different diameters and with rods having various distances between the end sections. The formation of two rear fastening elements can be performed either by fixing two spaced-apart fastening elements on the pullout guide or by arranging an integrally formed fastening part having two fastening elements spaced apart in the direction of the middle section of the horizontal rod. It is therefore not absolutely necessary to provide two separate components, even if this is advantageous. A receptacle or a gap thread in the angled end section of the rod is provided at least between the two fastening elements arranged in the rear region of the pullout guide, to thread in the angled end section of the rod, so that then when pushing on the pullout guide from the front, the two fastening elements form a guide. The rear fastening element preferably has a web which engages below the rear angled end section of the rod, so that tilt loads can also be absorbed well on the pullout guide. For guiding the pullout guide during the installation, the front of the two rear fastening elements can be formed substantially U-shaped viewed in the longitudinal direction of the rod, wherein the two legs of the U are aligned substantially horizontally. The tips of the legs face toward the inner wall with respect to a body, on the inner wall of which the side grid is arranged.

The fastening elements may include or consist of a stamped and bent metal plate, and they may be welded on a guide rail of the pullout guide. Other connection technologies can also be used.

The fastening system according to the may be used in a domestic appliance, in particular a baking oven having a body, wherein a fastening system is provided on opposing side walls of the baking oven. Alternatively, the fastening system according to the invention could also be used in furniture bodies in which a side grid is arranged on the side walls thereof.

In the method according to the disclosure, the pullout guide is preinstalled in that a front end section of a horizontal rod is threaded between two rear fastening elements fixed on the pullout guide, so that the end section is arranged between the two fastening elements. Subsequently, the pullout guide is displaced along the middle section of the horizontal rod, wherein the two fastening elements form a guide. A front fastening element is then placed on the front end section of the horizontal rod and the pullout guide is therefore detachably fixed on the rod. The placement of the front fastening element can optionally also be performed using catch means in this case, which are not absolutely necessary, however, since a substantially V-shaped receptacle is preferably formed on the front fastening element, which encloses the front end section of the rod from above.

DETAILED DESCRIPTION OF THE DRAWINGS

Figure 1A:
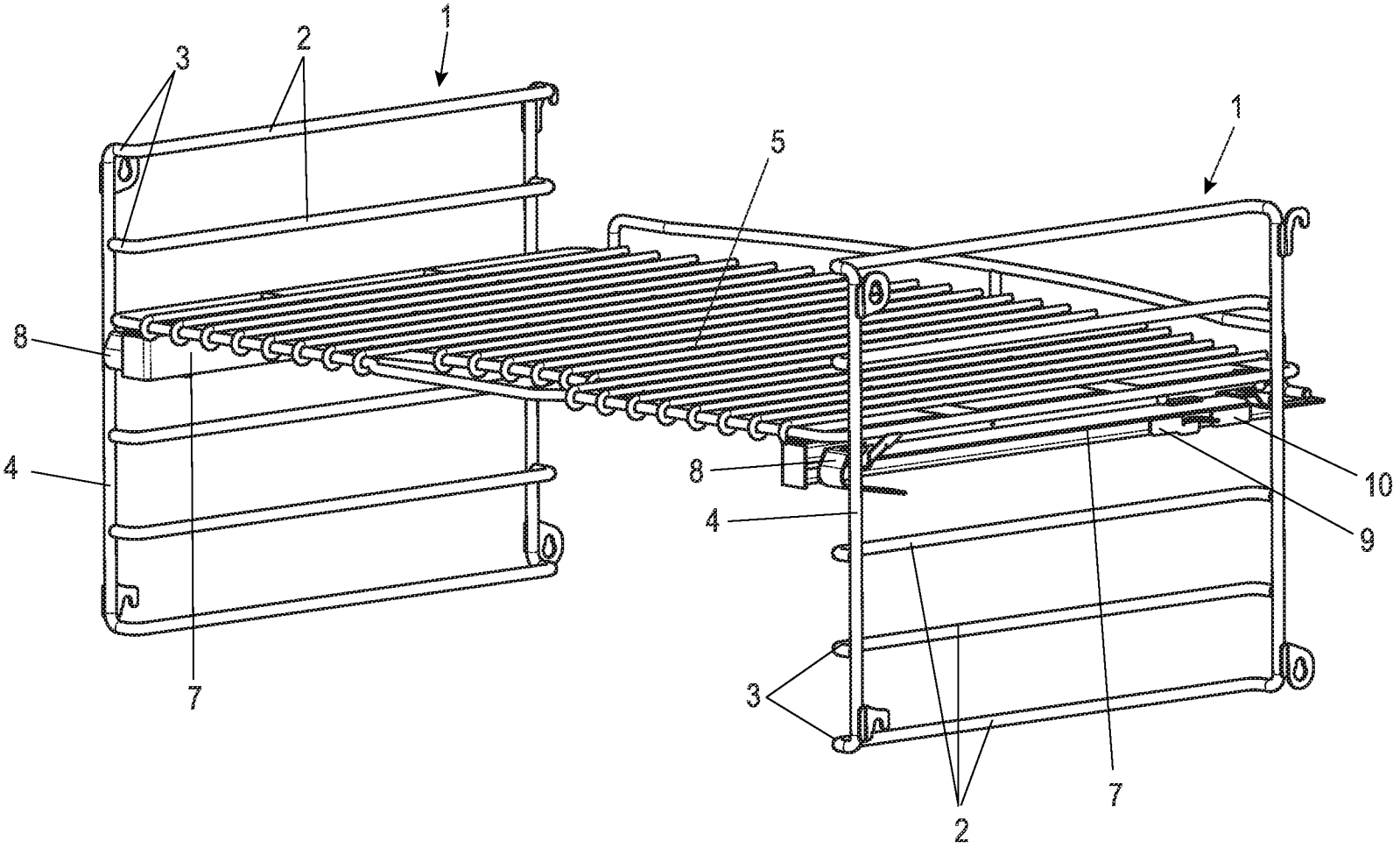
FIGS. 1A and 1B show two views of a fastening system according to the disclosure in the installed position together with a food support.
Figure 1B:
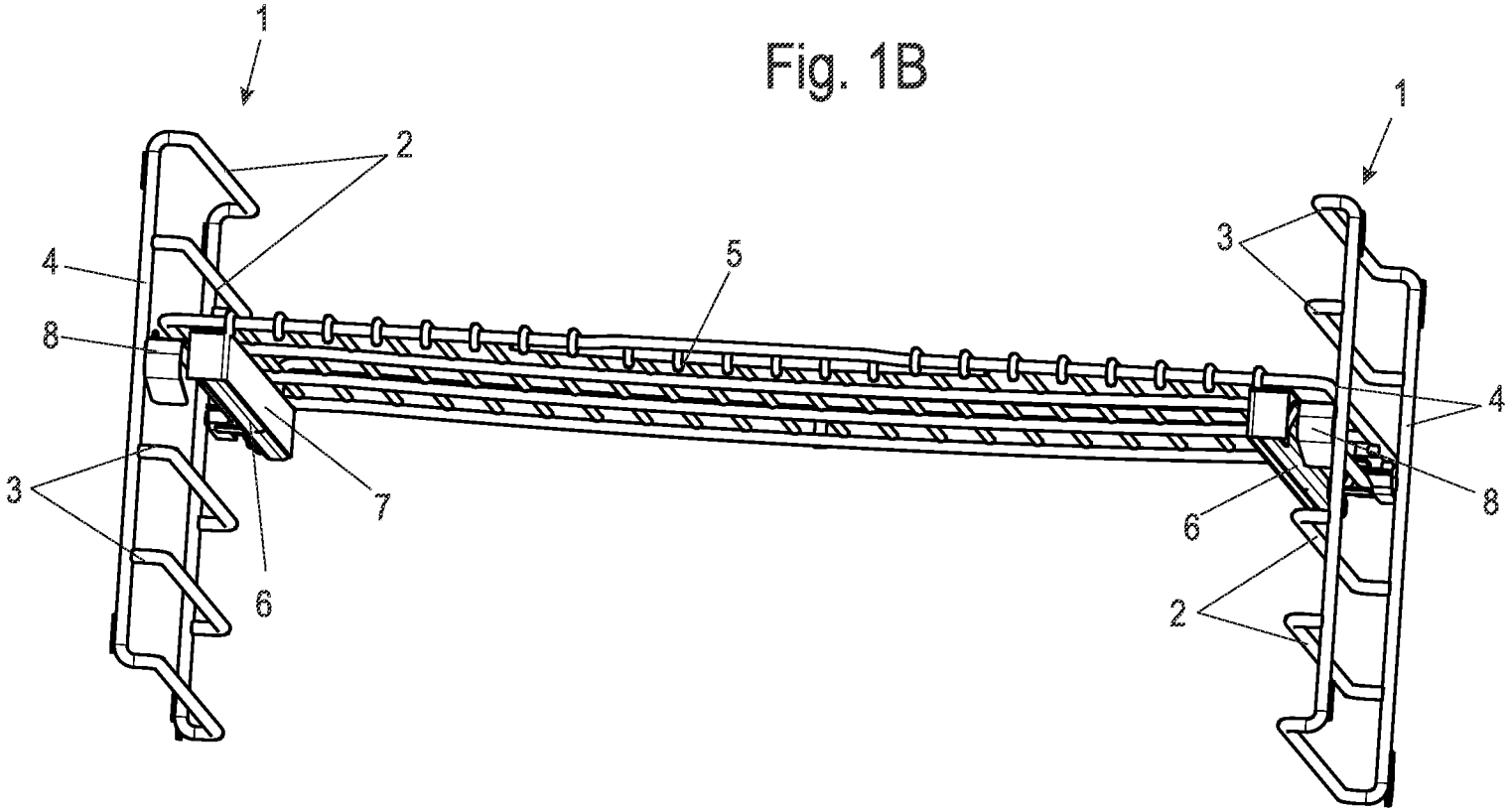

A fastening system, in particular for installation in a baking oven, comprises two side grids 1, which can be fixed on opposing inner sides of a baking oven. Each side grid 1 comprises a plurality of horizontal rods, which have a middle section 2 extending in the pullout direction and two angled end sections 3. Each angled end section 3 is connected to a vertical upright 4, wherein one upright 4 is arranged in front in the pullout direction and one upright 4 is arranged in the rear in the pullout direction. The terms "front" and "rear" refer in this case to the pullout direction, wherein a food support 5, for example, a grating, is supported on opposing sides on pullout guides 6, which can be pulled out forward. Each pullout guide 6 is held in a formfitting manner on a single horizontal rod in this case via fastening elements 8, 9, and 10. Toward the inner side, each pullout guide 6 is provided with a cover 7, which covers a gap between two rails of the pullout guide toward the inner side.

Figure 2A:
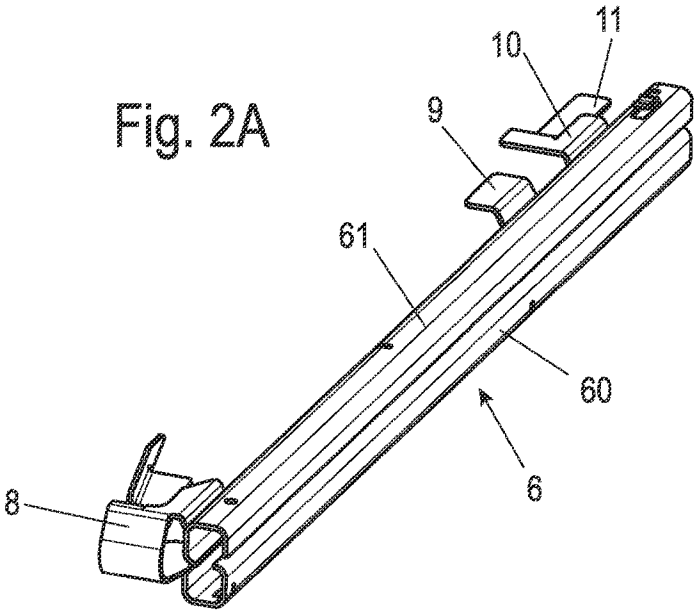
FIGS. 2A to 2D show multiple views of a pullout guide having three installed fastening elements.
Figure 2B:
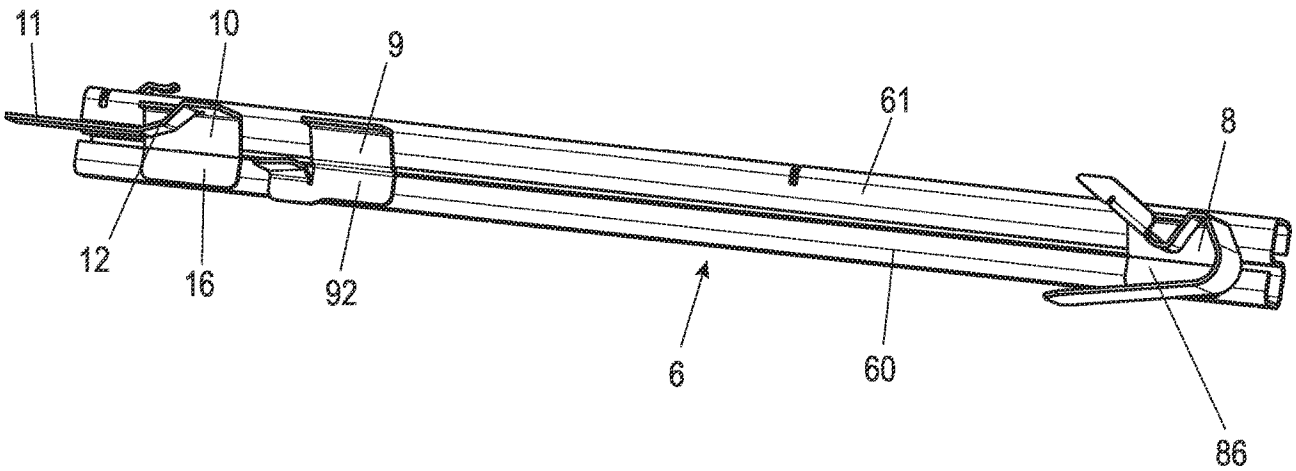
Figure 2C:
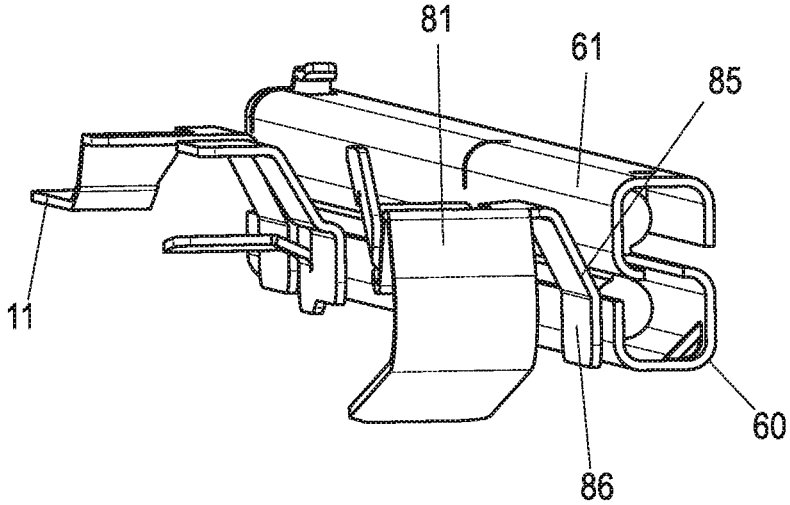
Figure 2D:
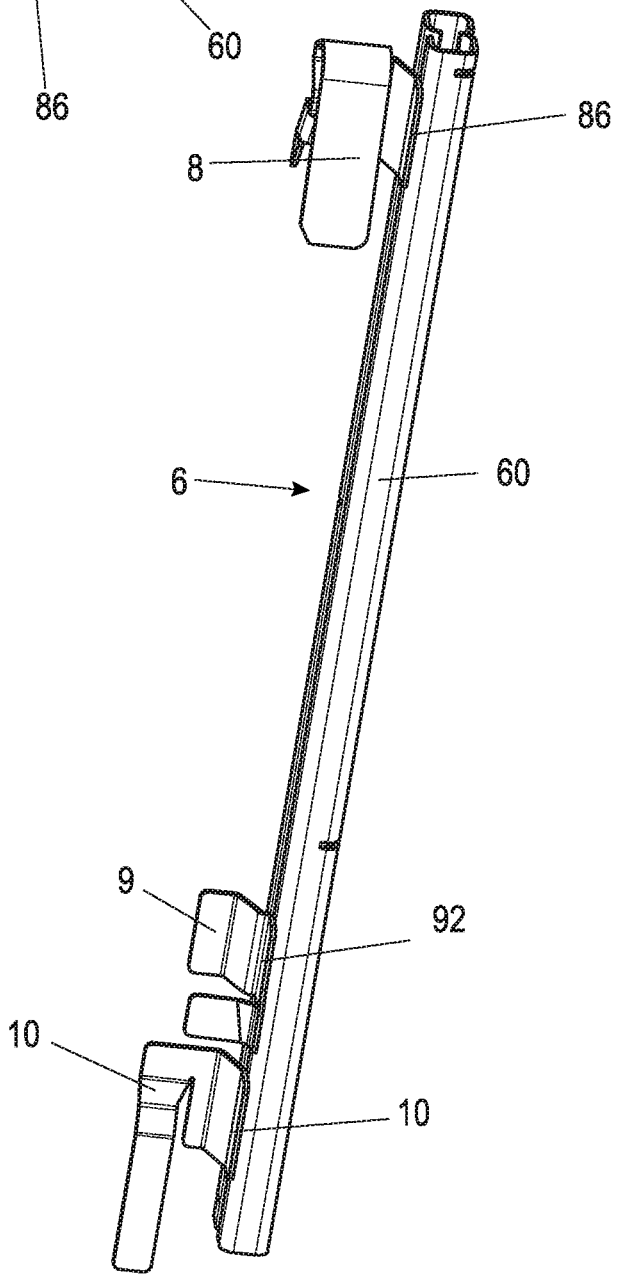
Figure 3A:
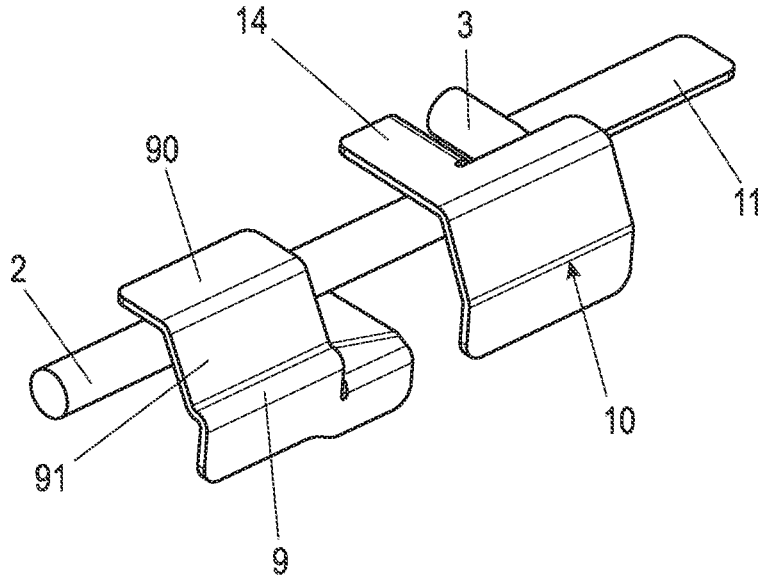
FIGS. 3A to 3D show two detail views of the rear fastening elements in the installed position.
Figure 3B:
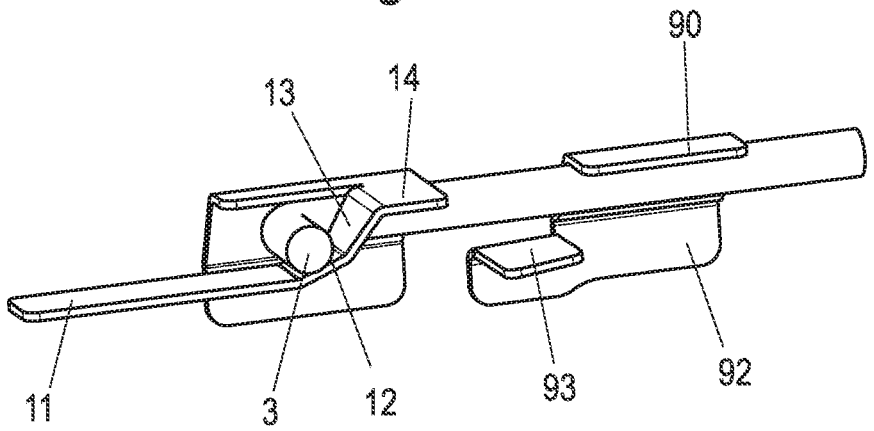
Figure 3C:
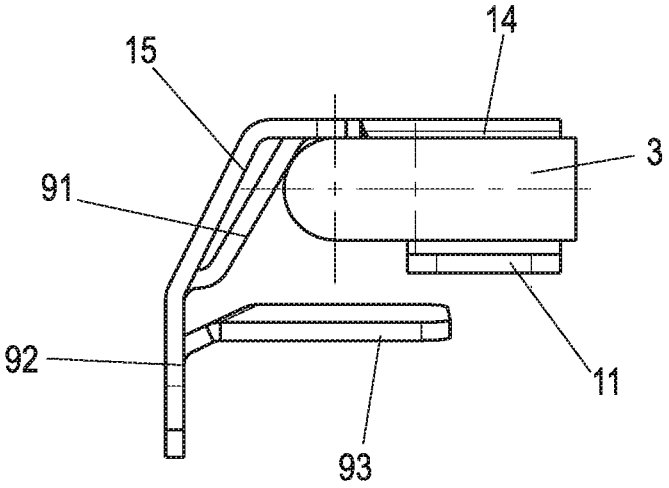
Figure 3D:
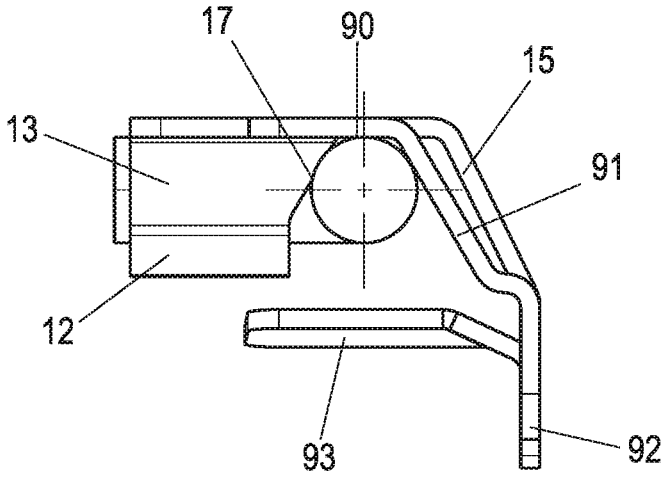

FIGS. 2A to 2C show a pullout guide 6, as is installable without cover 7 on a horizontal rod of a side grid 1. The pullout guide comprises a stationary guide rail 60 and an extendable slide rail 61, between which one or more metal rails are optionally provided for the pullout extension. The three fastening elements 8, 9, and 10 are fixed, preferably welded, on the guide rail 60. For this purpose, a vertical web is formed on the guide rail 60, against which a fastening section 16 of the fastening element 10, a fastening section 92 of the fastening element 9, and a fastening section 86 of the fastening element 8 each press and are welded.

On the rearmost fastening element 10 viewed in the pullout guide, a web 11 protruding to the rear is provided, which engages below an angled end section 3 of a rod. A web-shaped contact surface 12 adjoins the web 11, which is inclined in relation to the horizontal, for example, in a range between 10° and 30°.

This contact surface 12 presses against a lower side of the end section 3 and prevents a tilt movement of the pullout guide 6 when the slide rail 61 is arranged in an extended position and is loaded with a weight force.

The fixing of the pullout guide 6 by the rear fastening elements 9 and 10 will be explained in greater detail hereafter on the basis of FIGS. 3A to 3D. The rear fastening element 10 comprises the web 11 protruding to the rear, the inclined contact surface 12, and a connecting section 13 to an upper horizontal section 14, which at least regionally rests on the middle section 2 of the horizontal rod. On the outer side, i.e., facing toward the upright 4, the middle section 2 of the horizontal rod presses against a lateral edge 17 of the connecting section 13 formed as a contact surface, as is apparent from FIG. 3D. This lateral edge 17 is aligned inclined in relation to the vertical and the horizontal and is aligned at an angle of 20° to 40° in relation to the vertical. On the opposite side, the middle section 2 is not arranged directly on the fastening element 10, but rather has play in relation to a side web 15 of the rearmost fastening element 10. The side web 15 adjoins the fastening section 16 which is fixed on the guide rail 60.

The middle fastening element 9, which is arranged adjacent to the rear fastening element 10, has an upper horizontal web 90, on which an inclined contact surface 91 adjoins. This inclined contact surface 91 presses against a middle section 2 of the horizontal rod and is inclined in relation to the vertical, for example, between 20° and 40°. The fastening element 9 furthermore has a lower horizontal web 93, which is used for guiding the pullout guide 6 during the installation. The two webs 90 and 93 are connected to one another via a vertical fastening section 92, on which fixing of the fastening element on the guide rail 60 also occurs. The fastening element 9 is therefore formed substantially U-shaped viewed in the longitudinal direction of the middle section, wherein the legs of the U are aligned toward the outer side, i.e., toward the baking oven wall.

Figure 4A:
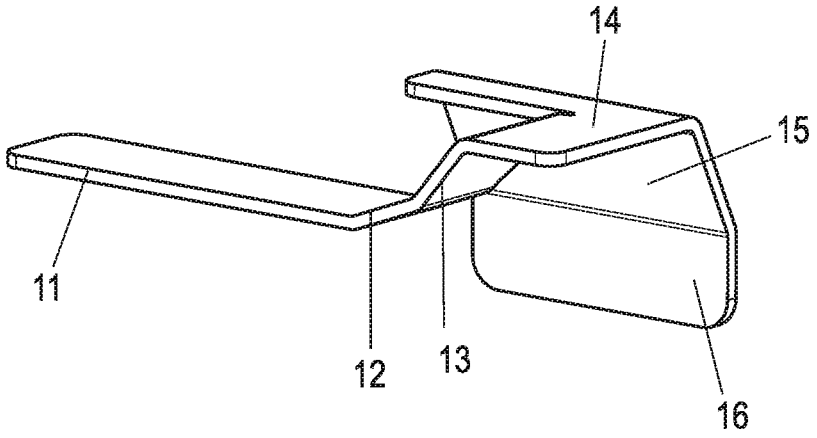
FIGS. 4A and 4B show two views of the rearmost fastening element without a rod.
Figure 4B:
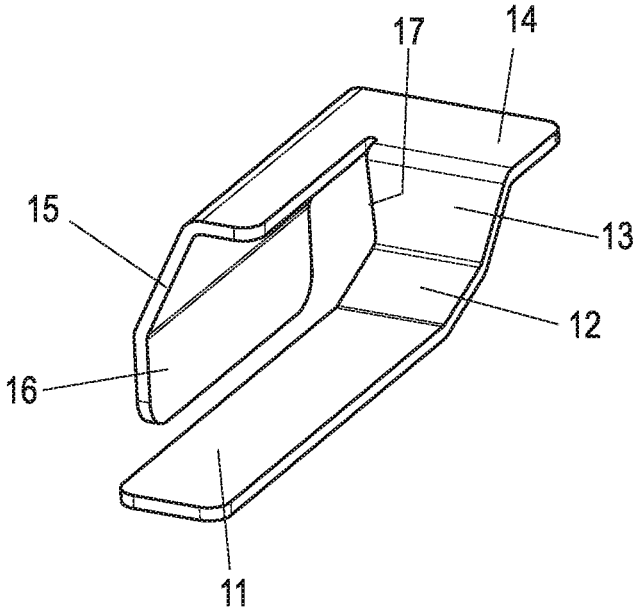

FIGS. 4A and 4B show the rearmost fastening element 10 in detail. The fastening element 10 is formed in one piece from a bent and stamped steel plate and it can be seen that the web 11 is aligned at an angle in relation to the contact surface 12, which is in turn formed at an angle in relation to the connecting section 13 having the lateral edge 17, which then merges at an angle into the horizontal section 14.

Figure 5A:
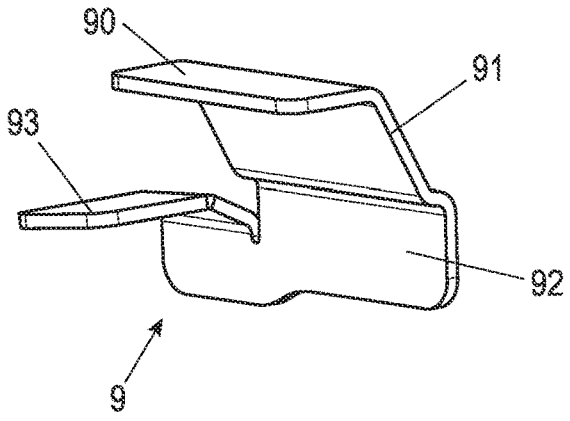
FIGS. 5A to 5C show multiple views of the two rear fastening element.
Figure 5B:
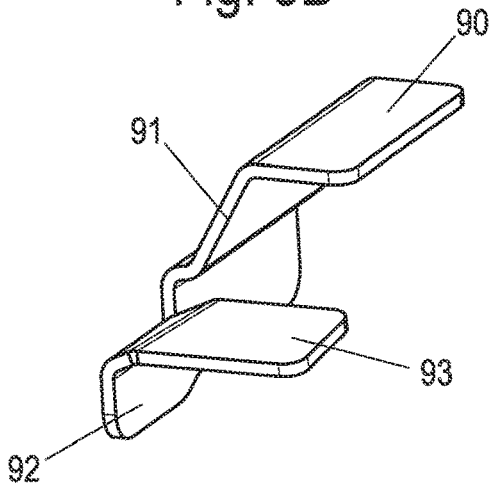
Figure 5C:
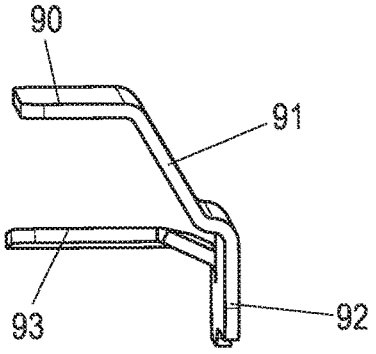
Figure 6A:
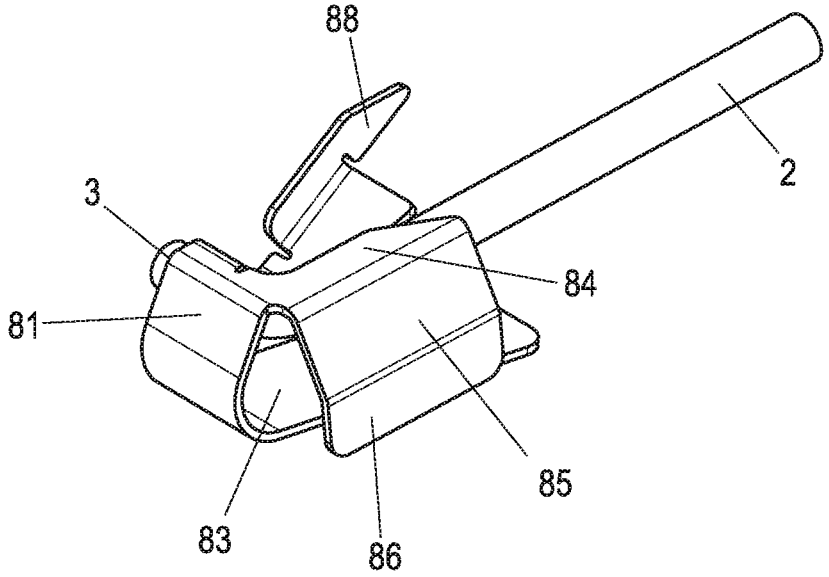
FIGS. 6A to 6D show multiple views of the front fastening element in the position installed on the rod.
Figure 6B:
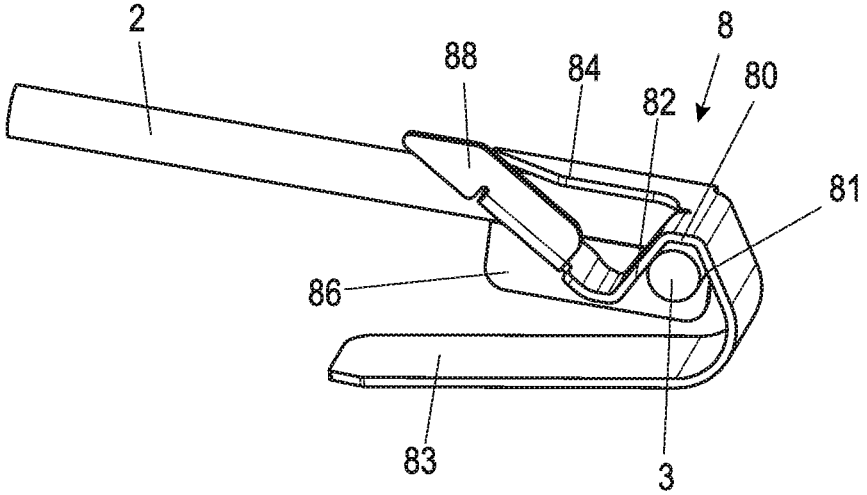
Figure 6C:
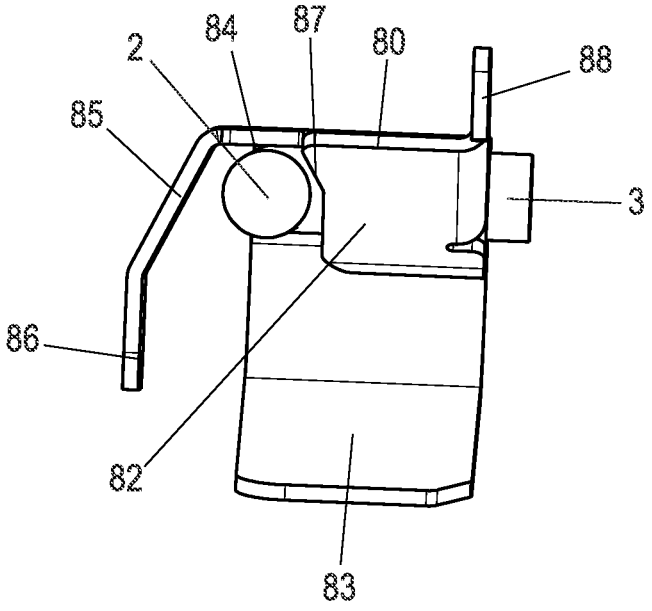
Figure 6D:
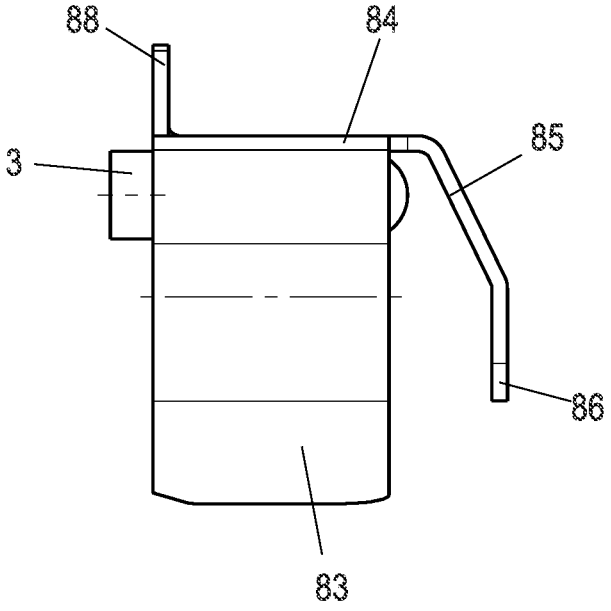

FIGS. 5A to 5C show the fastening element 9, which is also produced from a bent and stamped metal plate, in detail. During the installation, the horizontal webs 90 and 93 are relevant, which are used for guiding the pullout guide along the middle section 2, wherein the middle section 2 is accommodated with play between the two webs 90 and 93. In the installed position, the inclined contact surface 91 ensures that in the event of a weight load, the pullout guide cannot be displaced toward the outer side, wherein the two contact surfaces 91 and 17 form a V-shaped receptacle for the middle section 2 viewed in the longitudinal direction (cf. FIG. 3D).

FIGS. 6A to 6D show the front fastening element 8, which has a V-shaped receptacle for the angled end section 3 of the horizontal rod. The receptacle is delimited by a front contact surface 81, a rear contact surface 82, and a flat connecting section 80, wherein the contact surfaces 81 and 82 are arranged inclined between 20° and 40° in relation to the vertical. A tab 82 adjoins the contact surface 88, which can be applied to the outer side on the front upright 4 of the side grid 1. This thus prevents the fastening element 8 from being able to be displaced outward, although according to FIG. 6C, play is provided between the middle section 2 of the horizontal rod and a web 85 enclosing the middle section 2. A fastening section 86 and a horizontal section 84 adjoin the web 85 on the other side. The fastening element 8 is therefore secured against displacement in the horizontal direction perpendicularly in relation to the pullout direction by an inclined contact surface 87 at the contact surface 82 and a vertical contact surface which is applied to the upright 4. If a horizontal rod having enlarged diameter is to be arranged instead of the illustrated middle section 2, this is possible without problems, since the web 85 is arranged with horizontal play on the fastening element 8. The contact surface 82 is connected to an angled tab 88, which protrudes diagonally upward and therefore forms an insertion bevel together with a web 83, which is formed integrally with the contact surface 81 and extends substantially to the rear. During the installation, the angled end section 3 can therefore be guided between the angled tab 88 and the web 83 into the receptacle between the two contact surfaces 81 and 82.

Figure 7A:
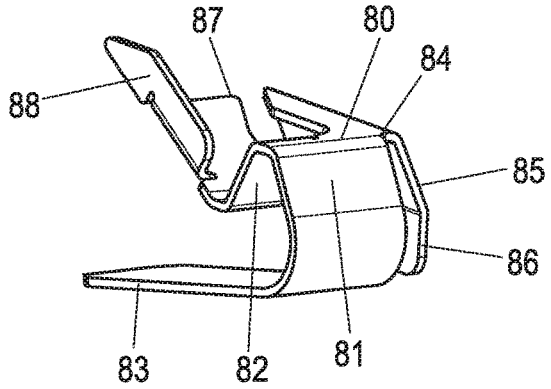
FIGS. 7A to 7C show multiple views of the front fastening element without the rod.
Figure 7B:
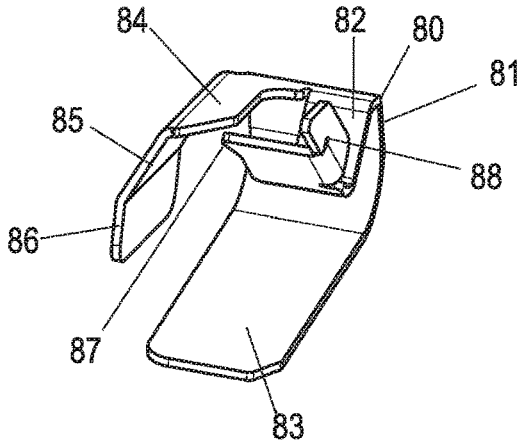
Figure 7C:
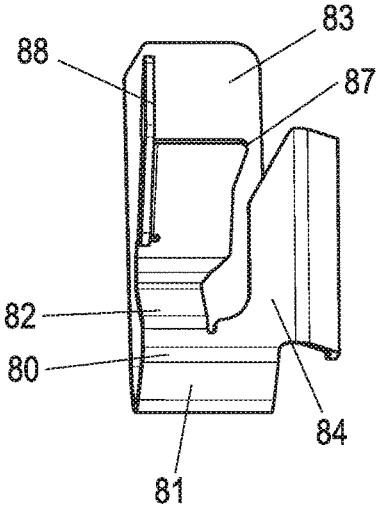

FIGS. 7A to 7C show the front fastening element 8 without the rod, and it is recognizable that a contact surface 87 is formed on the angled tab 88, which can be applied to an outer side of the middle section 2. Furthermore, the V-shaped receptacle having the contact surfaces 81 and 82 is visible, which prevents a displacement of the fastening element in the pullout direction.

To install the pullout guide having the three fastening elements 8, 9, and 10, firstly the front angled end section 3 of the horizontal rod is threaded between the fastening elements 9 and 10, so that the rear fastening element 10 rests with the upper horizontal section 14 on the middle section 2 and then the angled end section 3 is inserted between the two horizontal webs 90 and 93 of the fastening element 9. The pullout guide can now be displaced to the rear in the horizontal direction, wherein the two horizontal webs 90 and 93 and the fastening element 10 are used for guiding until the fastening element 10 having the web 11 protruding to the rear engages below the rear angled end section 3. In this position, the front angled end section 3 is arranged in the region of the front fastening element 8, and the pullout guide can now be lowered so that the angled end section enters the V-shaped receptacle having the contact surfaces 81 and 82. Tool-free installation is thus possible, and the pullout guide 6 can now be held without play on the side grid 1, so that in normal use a movement of the pullout guide 6 in relation to the side grid 1 is prevented due to load by weight forces or tilting forces in the extended position.

Figure 8A:
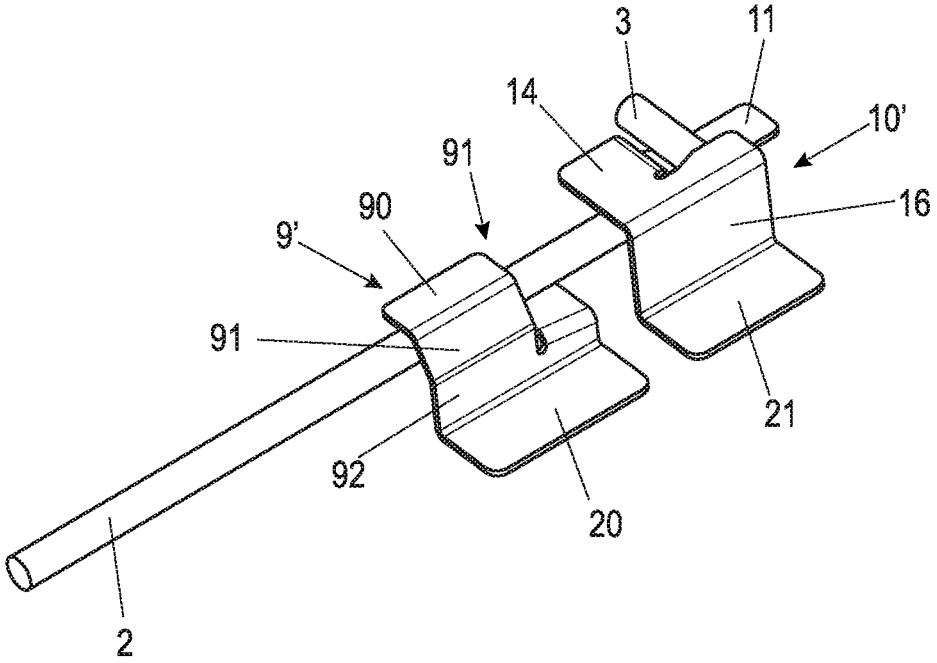
FIGS. 8A and 8B show two views of a modified exemplary embodiment of the rear fastening elements.
Figure 8B:
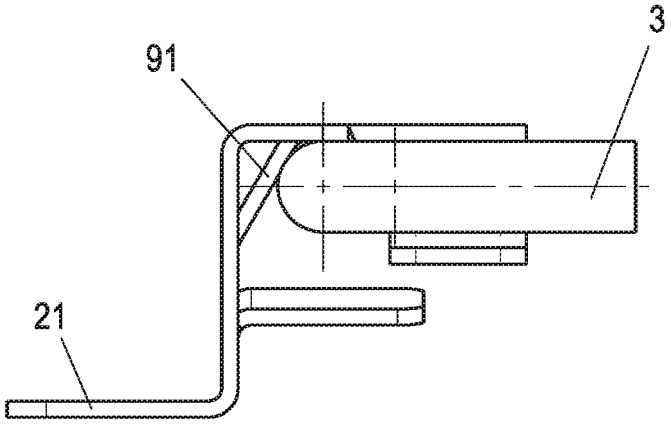

FIGS. 8A and 8B show a modified embodiment of the two rear fastening elements 9' and 10', which essentially corresponds to the first exemplary embodiment except for the difference that in the fastening element 9, a horizontal fastening web 20 is formed on the vertical fastening section 92. A horizontal fastening section 21 is also formed on the vertical fastening section 16 on the adjacent fastening element 10', so that the fastening of the pullout guide can now no longer be performed on a vertical web, but rather on a horizontal section.

Figure 9A:
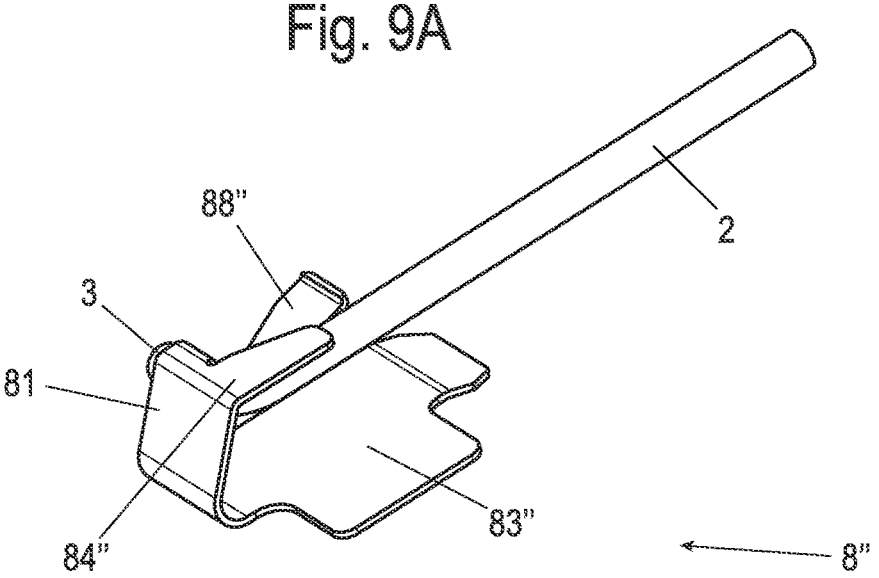
FIGS. 9A to 9C show multiple views of a modified exemplary embodiment of a front fastening element.
Figure 9B:
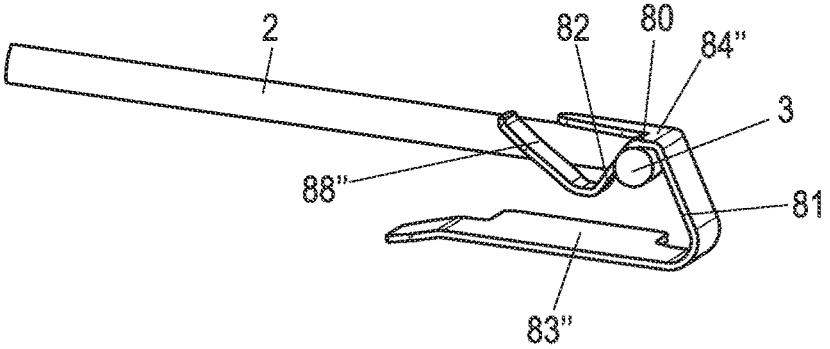
Figure 9C:
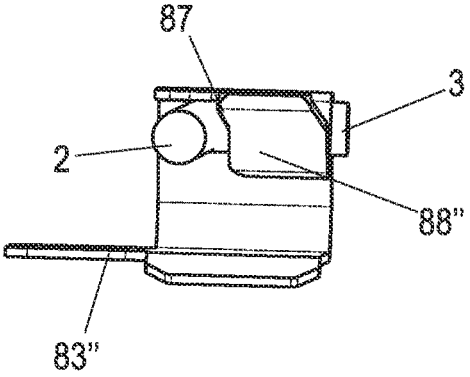

FIGS. 9A to 9C show a modified exemplary embodiment of a front fastening element 8", which, as in the preceding exemplary embodiment, has a V-shaped receptacle having contact surfaces 81 and 82 inclined in relation to the vertical, which enclose the front end section 3 from above. A tab 88" adjoins the contact surface 82, which is no longer formed angled, but rather web-shaped. An inwardly protruding contact surface 87 for contact on the middle section 2 is formed on the tab 88". Furthermore, an essentially horizontal web 83" is located integrally with the contact surface 81, which is used as an insertion aid for the installation of the end section 3 and on which a horizontal fastening section is additionally formed, on which the guide rail 60 of the pullout guide 6 can be fixed.

FIGS. 10A to 10D show a further exemplary embodiment of a modified front fastening element 8', which also has a V-shaped receptacle having contact surfaces 81 and 82, wherein a web-shaped tab 88' having a contact surface 87, which can be applied to the outer side of the middle section 2 of the horizontal rod, adjoins the contact surface 82. Toward the inner side, the fastening element 8 presses against a vertical upright 4. In this exemplary embodiment, the lower horizontal web 83' is formed shorter than in the preceding exemplary embodiment, and moreover the fastening of the fastening element is performed via a fastening section 86 and not via the horizontal web 83'.

FIGS. 11A to 11D show a modified exemplary embodiment of a rear fastening element 10, which is formed like the first exemplary embodiment in the region of the web 11 protruding to the rear, the contact surface 12, the connecting section 13, and the horizontal section 14. In the fastening element 10', a hook element 25 is located on the rear side, which protrudes upward beyond the horizontal section 14. The hook element 25 prevents the food support 5 from being able to be inserted in an incorrect plane into the side grid 1. If the user wishes to lay the food support 5 directly on the rod, the hook element 25 prevents the food support 5 from being able to be inserted into the side grid 1, by the hook element 25 striking in front of the front angled end section 3 of the rod. Instead of a hook element 25, an upwardly protruding step having the same function can also be provided. The hook element 25 or the step can be provided in the other embodiment of the rearmost fastening element 10.

Figure 10A:
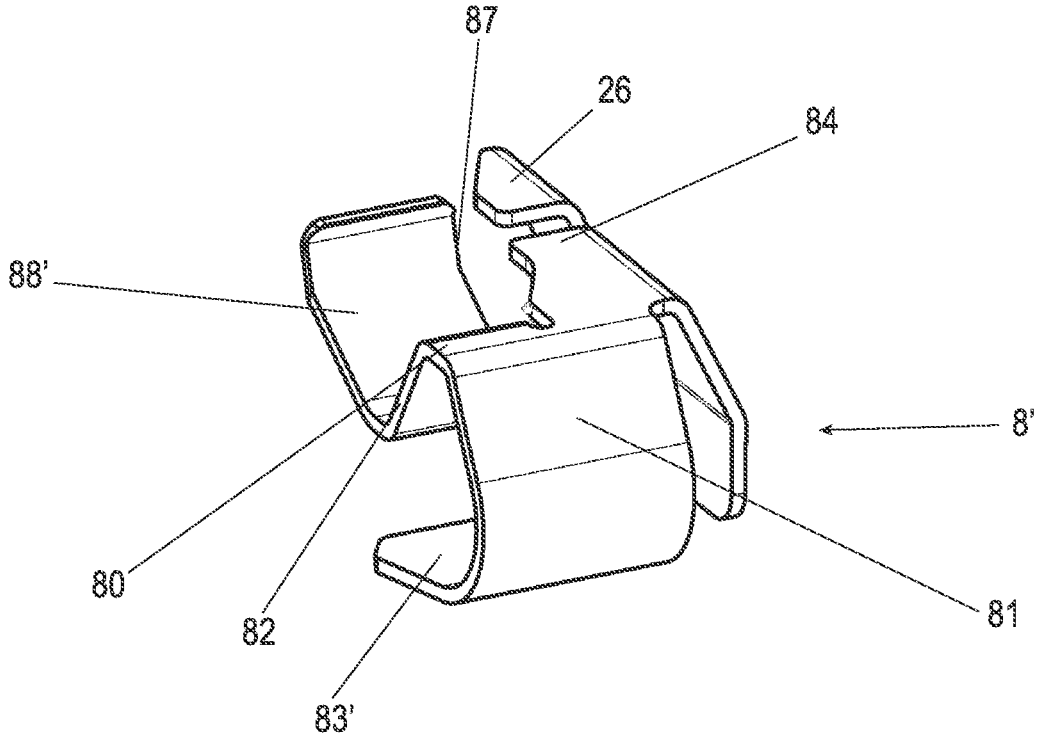
FIGS. 10A to 10D show multiple views of a modified exemplary embodiment of a front fastening element.
Figure 10B:
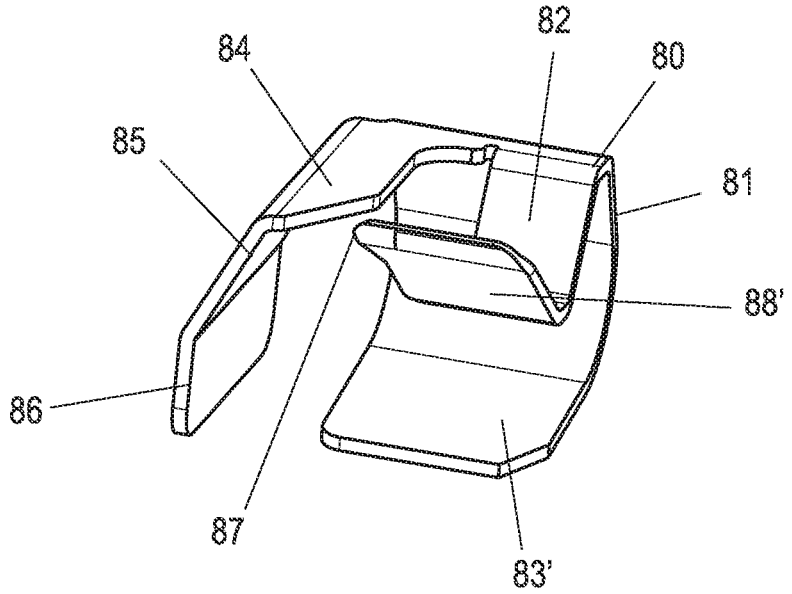
Figure 10C:
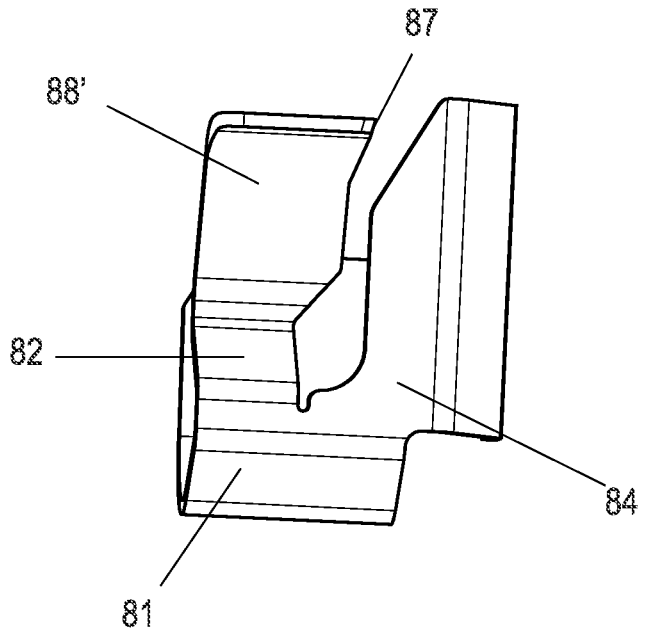
Figure 10D:
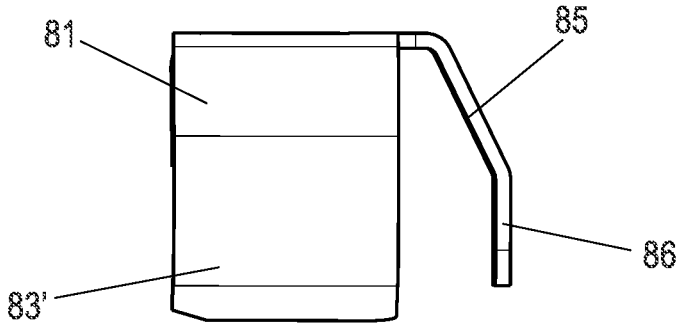
Figure 11A:
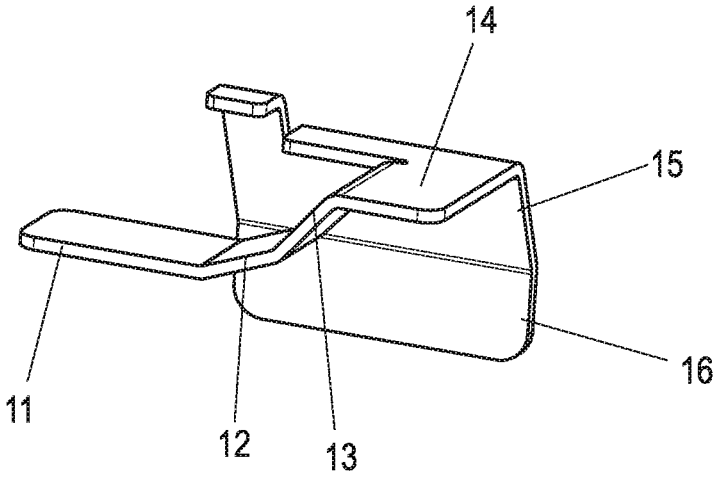
FIGS. 11A to 11D show multiple views of a modified exemplary embodiment of a rearmost fastening element.
Figure 11B:
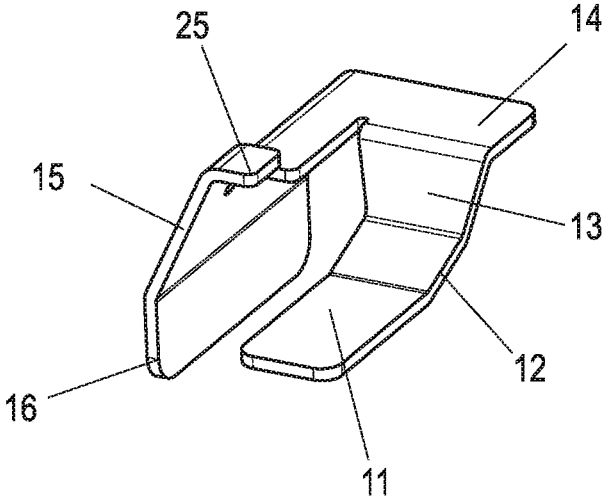
Figure 11C:
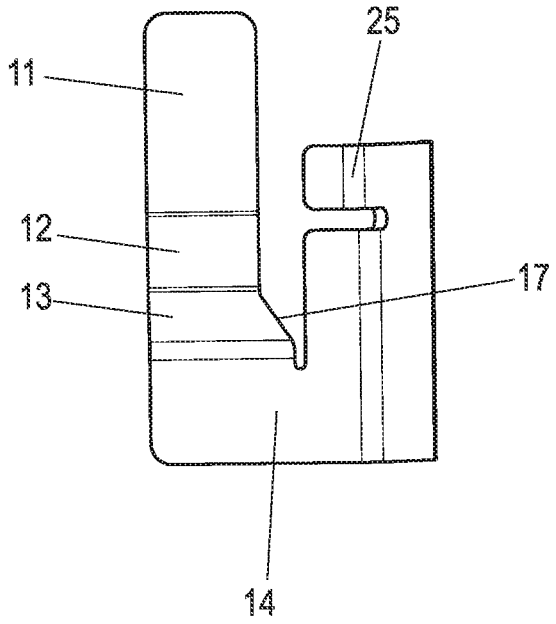
Figure 11D:
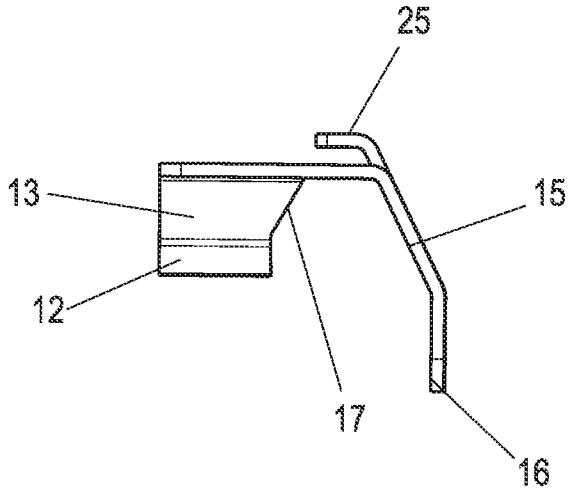

FIG. 10A shows that the front fastening element 8' is also provided with a hook element 26 protruding upward beyond the horizontal section 84'. This thus prevents the food support 5 from being able to be inserted skewed. If the rod in the first step of the installation is correctly engaged with the rear fastening elements 9, 10, during the further installation it could happen without a corresponding hook element 26 that the food support 5 is lowered onto the rod as it is pushed on. As soon such a skewed insertion exists, the hook element 26 strikes on the front angled end section 3 and prevents a further insertion of the food support 5. Instead of a hook element 26, an upwardly protruding step having the same function can also be provided. The hook element 26 or the step can also be provided in the other embodiments of the front fastening element 8, 8". To prevent a skewed insertion, the web 11 on the rearmost fastening element 10, 10' could alternatively also be designed so that in the event of a skewed position of the food support 5, in the further course of installation, the web 11 strikes against the rear angled end section 3 of the rod, and thus prevents further pushing on of the food support 5.

In a fastening system, corresponding hook elements (25, 26) or steps can also be provided on the rearmost (10, 10') and on the front fastening element (8, 8', 8").

The illustrated exemplary embodiments can be combined with one another as desired, wherein, for example, the fastening element illustrated in FIG. 11 can be combined with the fastening elements of FIGS. 4 and 5 for a fastening system.

The invention claimed is:

1. A fastening system having a side grid, a pullout guide, a front fastening element fixed on the pullout guide, and a rear fastening element fixed on the pullout guide, by means of which the pullout guide is fixed in a formfitting manner on a horizontal rod of the side grid, wherein the horizontal rod has a middle section extending in a longitudinal direction and two angled end sections, which are each fixed on an upright of the side grid, wherein at least the front fastening element has at least one contact surface inclined in relation to the vertical for contact on the middle section of the horizontal rod, and at least the rear fastening element has a contact surface inclined in relation to the vertical on the middle section of the horizontal rod, wherein an essentially V-shaped receptacle is formed on the front fastening element, which encloses the front angled end section of the horizontal rod from above, and wherein the essentially V-shaped receptacle is formed by contact surfaces, and all contact surfaces on the fastening elements for contact on the horizontal rod are formed inclined in relation to the horizontal and the vertical.

2. The fastening system according to claim 1, wherein the contact surfaces on the front and rear fastening elements are inclined by at least 10° in relation to the vertical.

3. The fastening system according to claim 1, further comprising a middle fastening element fixed on the pullout guide.

4. The fastening system according to claim 3, wherein the middle and rear fastening elements are spaced apart from one in a rear region of the pullout guide, between which middle and rear fastening elements a gap is formed for threading in the front end section of the horizontal rod.

5. The fastening system according to claim 3, wherein the middle fastening element is formed substantially U-shaped viewed in the longitudinal direction of the horizontal rod.

6. The fastening system according to claim 1, wherein the rear fastening element has a web, which engages below the rear angled end section of the horizontal rod.

7. The fastening system according to claim 1, wherein a lateral movement of the front fastening element is delimited on one side by the upright and on the opposite side by a contact surface on the middle section of the horizontal rod.

8. The fastening system according to claim 1, wherein the rear fastening element and/or the front fastening element has a horizontal section resting on the middle section of the horizontal rod and a hook element protruding upward beyond the horizontal section.

9. The fastening system according to claim 1, wherein the front and rear fastening elements are connected to a guide rail of the pullout guide.

10. A domestic appliance having a fastening system according to claim 1.

11. The fastening system according to claim 1 wherein the contact surfaces on each of the front and rear fastening elements are inclined by between 20° and 40° in relation to the vertical.

12. A fastening system having a side grid, a pullout guide, a front fastening element fixed on the pullout guide, a middle fastening element fixed on the pullout guide, and a rear fastening element fixed on the pullout guide, by means of which the pullout guide is fixed in a formfitting manner on a horizontal rod of the side grid, wherein the horizontal rod has a middle section extending in a longitudinal direction and two angled end sections, which are each fixed on an upright of the side grid, wherein at least the front fastening element has at least one contact surface inclined in relation to the vertical for contact on the middle section of the horizontal rod, and at least the rear fastening element has a contact surface inclined in relation to the vertical on the middle section of the horizontal rod, wherein an essentially V-shaped receptacle is formed on the front fastening element, which encloses the front angled end section of the horizontal rod from above, and wherein the middle and the rear fastening elements are spaced apart from one another, thereby defining a gap for threading in the front end section of the rod.

13. The fastening system of claim 12 wherein the essentially V-shaped receptacle is formed by contact surfaces, and all contact surfaces on the fastening elements for contact on the horizontal rod are formed inclined in relation to the horizontal and the vertical.

14. The fastening system according to claim 12, wherein the contact surfaces on the front and rear fastening elements are inclined by at least 10° in relation to the vertical.

15. The fastening system according to claim 12, wherein the rear fastening element has a web, which engages below the rear angled end section of the horizontal rod.

16. The fastening system according to claim 12, wherein the middle fastening element is formed substantially U-shaped viewed in the longitudinal direction of the horizontal rod.

17. The fastening system according to claim 12, wherein a lateral movement of the front fastening element is delimited on one side by the upright and on the opposite side by a contact surface on the middle section of the horizontal rod.

18. The fastening system according to claim 12, wherein the rear fastening element and/or the front fastening element has a horizontal section resting on the middle section of the horizontal rod and a hook element protruding upward beyond the horizontal section.

19. The fastening system according to claim 12, wherein the front and rear fastening elements are connected to a guide rail of the pullout guide.

20. A domestic appliance having a fastening system according to claim 12.

21. The fastening system according to claim 12 wherein the contact surfaces on each of the front and rear fastening elements are inclined by between 20° and 40° in relation to the vertical.

22. A method for installing a fastening system having a pullout guide and a side grid having a horizontal web having a middle section extending in the longitudinal direction and two angled end sections, which are each fixed on an upright of the side grid, having the following steps:

threading the front end section of the rod between two rear fastening elements fixed on the pullout guide;

displacing the pullout guide along the middle section to the rear, wherein the two fastening elements form a guide, and placing a front fastening element on the front end section for the detachable fixing of the pullout guide on the horizontal rod.

* * * * *